US007937015B2

(12) United States Patent
Furuichi et al.

(10) Patent No.: US 7,937,015 B2
(45) Date of Patent: May 3, 2011

(54) IMAGE FORMING APPARATUS HAVING A DEVELOPMENT DEVICE MIXING AND CONVEYING DEVELOPER

(75) Inventors: Yuusuke Furuichi, Ikeda (JP); Nobuhiko Kita, Suita (JP); Sei Onuma, Ikeda (JP); Ryoh Idehara, Kawanishi (JP); Kaoru Tada, Toyonaka (JP); Genta Hagiwara, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/550,866

(22) Filed: Aug. 31, 2009

(65) Prior Publication Data

US 2010/0061755 A1 Mar. 11, 2010

(30) Foreign Application Priority Data

Sep. 8, 2008 (JP) ..... 2008-229297

(51) Int. Cl.
*G03G 21/20* (2006.01)
*G03G 15/01* (2006.01)
*G03G 15/08* (2006.01)

(52) U.S. Cl. ..... 399/94; 399/12; 399/119

(58) Field of Classification Search ..... 399/94, 399/92, 119, 12, 252
See application file for complete search history.

(56) References Cited

U.S. PATENT DOCUMENTS

| | | | | |
|---|---|---|---|---|
| 7,555,244 | B2 | 6/2009 | Idehara et al. | 399/223 |
| 2002/0191982 | A1 * | 12/2002 | Tsukamoto et al. | 399/94 |
| 2004/0114971 | A1 * | 6/2004 | Sakai et al. | 399/284 |
| 2007/0110473 | A1 | 5/2007 | Kondo et al. | 399/117 |
| 2008/0063425 | A1 | 3/2008 | Idehara et al. | 399/93 |
| 2008/0253796 | A1 | 10/2008 | Idehara et al. | 399/92 |
| 2009/0269098 | A1 * | 10/2009 | Mori et al. | 399/94 |
| 2009/0285588 | A1 | 11/2009 | Furuichi et al. | |

FOREIGN PATENT DOCUMENTS

| | | | |
|---|---|---|---|
| JP | 63-144371 | | 6/1988 |
| JP | 05-188754 | A * | 7/1993 |
| JP | 2003-107906 | A * | 4/2003 |
| JP | 2004-126003 | | 4/2004 |
| JP | 2005-164771 | | 6/2005 |
| JP | 2007-187922 | A * | 7/2007 |
| JP | 2007-226148 | | 9/2007 |
| JP | 2007-256873 | | 10/2007 |

* cited by examiner

*Primary Examiner* — Sophia S Chen
(74) *Attorney, Agent, or Firm* — Oblon, Spivak, McClelland, Maier & Neustadt, L.L.P.

(57) ABSTRACT

An image forming apparatus includes an image carrying member carrying a latent image and a development device disposed along a surface of the image carrying member. The development device includes a developer storing case storing a developer, a developer carrying member carrying the developer to develop the latent image with the developer in an area in which the surface of the developer carrying member faces the surface of the image carrying member, a developer supplying member supplying the developer carrying member with the developer, a metal member extending in an axial direction of the developer carrying member to receive heat conducted from the developer, and a heat releasing device provided on at least one of the outer sides of the developer storing case in the axial direction of the developer carrying member and disposed in contact with the metal member to release the heat conducted from the metal member.

18 Claims, 6 Drawing Sheets

IMAGE FORMING APPARATUS HAVING A DEVELOPMENT DEVICE MIXING AND CONVEYING DEVELOPER

CROSS-REFERENCE TO RELATED APPLICATION

The present invention claims priority pursuant to 35 U.S.C. §119 from Japanese Patent Application No. 2008-229297, filed on Sep. 8, 2008 in the Japan Patent Office, which is hereby incorporated by reference herein in its entirety.

BACKGROUND OF THE INVENTION

1. Field of the Invention

The present invention relates to an image forming apparatus such as a printer, a facsimile machine, and a copier.

2. Discussion of the Related Art

In a development device used in an image forming apparatus such as a printer, a facsimile machine, or a copier, when a member such as a developer mixing and conveying member for mixing and conveying developer in the development device is driven, the developer mixing and conveying member and the developer rub against each other. As a result, frictional heat is generated, and the development device acts as a heating element. The generation of such frictional heat results in the heating and deterioration of the developer in the development device.

In one related-art image forming apparatus, a bottom plate of the development device is formed of a metal material, and a surface of the bottom plate forming the exterior of the development device is provided with a plurality of metal cooling fins projecting downward from the development device. With this configuration, the heat of the developer stored in the development device can be efficiently released outside the development device by the cooling fins via the bottom plate. Accordingly, an increase in temperature of the developer can be suppressed.

Meanwhile, along with continued reductions in size of the image forming apparatus, an image carrying member for carrying a latent image on a surface thereof, such as a photoconductor drum and a photoconductor belt, is also becoming more compact. In the above-described image forming apparatus, the development device and a variety of other devices relating to the image forming operation are disposed along the surface of the image carrying member for carrying thereon the latent image. Therefore, along with the size reduction of the image forming apparatus, the distances between the devices are reduced, and available space is reduced. The available space is particularly limited in an area around the surface of the image carrying member and on the downstream side of the development device in the direction of movement of the surface of the image carrying member. This is because the area includes, for example, a transfer device for transferring a toner image on the image carrying member onto a transfer member or an intermediate transfer member, and a conveying path of the transfer member or the intermediate transfer member. Therefore, if the above-described related-art development device including the cooling fins projecting from the bottom plate thereof is provided in the body of the above-described image forming apparatus having a limited available space, the degree of freedom in the design of the layout of the devices provided around the surface of the image carrying member is severely restricted.

SUMMARY OF THE INVENTION

This patent specification describes an image forming apparatus. In one example, an image forming apparatus includes an image carrying member to carry a latent image on a surface thereof and a development device disposed along the surface of the image carrying member. The development device includes a developer storing case, a developer carrying member, a developer supplying member, a metal member, and a heat releasing device. The developer storing case stores a developer. The developer carrying member carries the developer on a surface thereof to develop the latent image with the developer in an area in which the surface of the developer carrying member faces the surface of the image carrying member. The developer supplying member supplies the developer carrying member with the developer stored in the developer storing case. The metal member extends in an axial direction of the developer carrying member to receive heat conducted from the developer stored in the developer storing case. The heat releasing device is provided on at least one of the outer sides of the developer storing case in the axial direction of the developer carrying member and disposed in contact with the metal member to release the heat conducted from the metal member.

The metal member may be provided at a position facing at least one of the developer carrying member and the developer supplying member, with a predetermined distance interposed between the metal member and the at least one of the developer carrying member and the developer supplying member.

The metal member may form at least a part of the developer storing case.

The metal member may be shaped to fit the outer shape of at least one of the developer carrying member and the developer supplying member.

The developer carrying member and the developer supplying member may be two roller members in contact with each other at respective surfaces thereof. The metal member may be provided at a position facing a portion in which the developer carrying member and the developer supplying member may be in contact with each other at the respective surfaces thereof.

The metal member may have a portion of enhanced thickness disposed facing at least a portion in which the developer carrying member and the developer supplying member may be in contact with each other.

The above-described image forming apparatus may further include a drive force transmission device provided on one of the outer sides of the developer storing case in the axial direction of the developer carrying member. The device force transmission device may include a gear train which transmits drive force to the developer carrying member and the developer supplying member from a driving device for driving the developer carrying member and the developer supplying member. The heat releasing device may be provided on the one of the outer sides of the developer storing case in the axial direction of the developer carrying member on which the drive force transmission device is provided.

The development device may further include a resin cover having at least one hole formed therein, and the development device may cover the heat releasing device.

The above-described image forming apparatus may further include a pair of body frames disposed facing each other in the axial direction of the developer carrying member with the development device interposed therebetween and an air current generation device provided to that body frames which is disposed on the side of the heat releasing device and generating an air current.

The heat releasing device may include a heat sink.

The heat sink may be integrated with the metal member to form a single unit.

The heat sink may include a metal plate.

The heat sink may have at least one hole.

The heat sink may include a bent portion.

The above-described image forming apparatus may further include a pair of body frames disposed facing each other in the axial direction of the developer carrying member with the development device interposed therebetween. The development device may include a plurality of detachably attachable development devices, the plurality of development devices differing in the color of toner sealed therein and in the shape and location of the bent portion thereof. Each of the pair of body frames may include one or more grooves allowing installation of only a corresponding development device of the plurality of development devices by allowing only the bent portion of the corresponding development device to pass through the groove in the installation of the plurality of development devices in the image forming apparatus.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
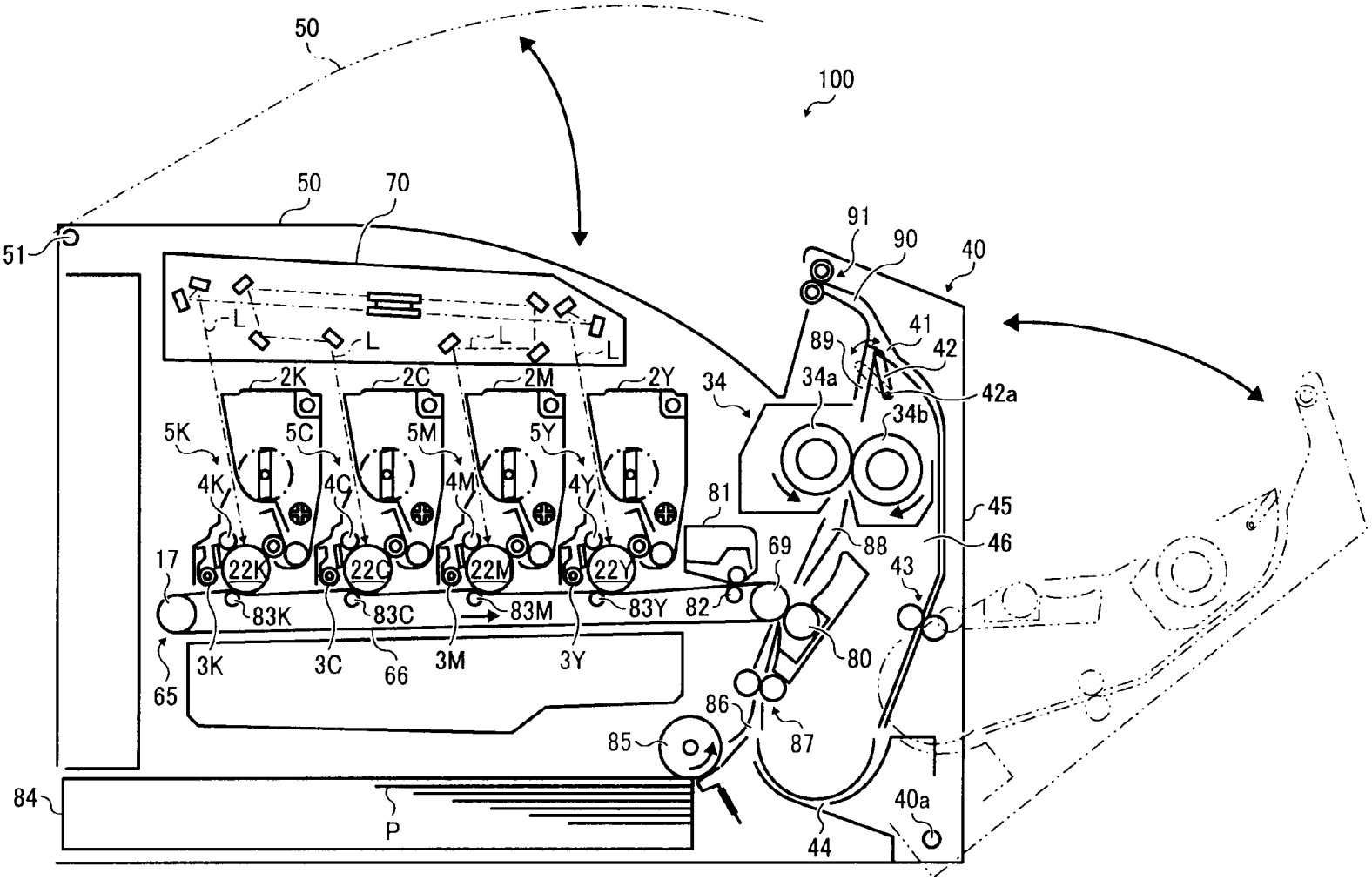
FIG. 1 is a schematic configuration diagram of a printer according to an exemplary embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, an exemplary embodiment of a printer 100 according to an electrophotographic method (hereinafter simply referred to as the printer 100) will be described below as an image forming apparatus according to an exemplary embodiment of the present invention.

A basic configuration of the printer 100 of the exemplary embodiment will be first described. FIG. 1 is a schematic configuration diagram illustrating the printer 100 of the exemplary embodiment. In the drawing, the printer 100 mainly includes process cartridges 5Y, 5M, 5C, and 5K (alternatively referred to collectively as the process cartridges 5), a writing device 70, a transfer unit 65, a fixing unit 34, a reversing unit 40, an upper cover 50, and a sheet feeding cassette 84.

The four process cartridges 5Y, 5M, 5C, and 5K form toner images of yellow, magenta, cyan, and black colors (hereinafter referred to as Y, M, C, and K), respectively. The process cartridges 5Y, 5M, 5C, and 5K are similar in configuration except for the use of toners of different colors, i.e., Y toner, M toner, C toner, and K toner, as image forming materials, and are replaced when the life thereof expires.

The operation in the process cartridges 5 will be described, with the process cartridge 5K taken as an example. The process cartridge 5K for forming a K toner image includes a photoconductor drum 22K having a drum shape and serving as a latent image carrying member, a drum cleaning device 3K, a diselectrification device (not illustrated), a charging device 4K, a development unit 2K, and so forth. Process cartridges 5Y, 5M, and 5C similarly include drum cleaning devices 3Y, 3M, and 3C, respectively, and charging devices 4Y, 4M, and 4C, respectively. The process cartridge 5K serving as an image forming unit is detachably attachable to the body of the printer 100, and expendable components thereof can be replaced at one time.

The charging device 4K uniformly charges a surface of the photoconductor drum 22K rotated in the clockwise direction in the drawing by a driving device (not illustrated). The uniformly charged surface of the photoconductor drum 22K is then subjected to exposure scanning with laser light L, and carries thereon an electrostatic latent image for the K color. The electrostatic latent image for the K color is developed into a K toner image by the development unit 2K using the K toner. Then, the K toner image on the photoconductor drum 22K is transferred onto an intermediate transfer belt 66 of the transfer unit 65 described later. That is, an intermediate transfer process is performed. The drum cleaning device 3K removes post-transfer residual toner adhering to the surface of the photoconductor drum 22K subjected to the intermediate transfer process. Further, the diselectrification device diselectrifies the residual charge on the photoconductor drum 22K subjected to the cleaning process. With this diselectrification process, the surface of the photoconductor drum 22K is initialized and prepared for the next image forming operation. Also in the other process cartridges 5Y, 5M, and 5C for the other colors, a Y toner image, an M toner image, and a C toner image are similarly formed on the photoconductor drums 22Y, 22M, and 22C, respectively, and transferred onto the intermediate transfer belt 66 described later in the intermediate transfer process.

In FIG. 1 described above, the writing device 70 is provided vertically above the process cartridges 5Y, 5M, 5C, and 5K. As described above, with the use of the laser light L emitted from a laser diode (not illustrated) and on the basis of image information, the writing device 70 serving as a latent image writing device performs the exposure scanning on the photoconductor drums 22Y, 22M, 22C, and 22K of the process cartridges 5Y, 5M, 5C, and 5K. Thereby, electrostatic latent images for the Y, M, C, and K colors are formed on the photoconductor drums 22Y, 22M, 22C, and 22K. The writing device 70 applies the laser light L emitted from the light source to the photoconductor drums 22Y, 22M, 22C, and 22K via a plurality of optical lenses and mirrors, while polarizing the laser light L in the main scanning direction by the use of a polygon mirror driven to rotate by a polygon motor (not illustrated). Alternatively, the writing device 70 may employ a technique of performing optical writing with LED (Light Emitting Diode) light emitted from a plurality of LEDs in an LED array.

At a position vertically below the process cartridges 5Y, 5M, 5C, and 5K, the transfer unit 65 is provided which circularly moves the stretched circular intermediate transfer belt 66 in the counterclockwise direction in the drawing. In addition to the intermediate transfer belt 66, the transfer unit 65 serving as a transfer device includes a driving roller 17, a driven roller 69, four primary transfer rollers 83Y, 83M, 83C, and 83K, a secondary transfer roller 80, a belt cleaning device 81, a cleaning backup roller 82, and so forth.

The intermediate transfer belt 66 is stretched over the driving roller 17, the driven roller 69, the cleaning backup roller 82, and the four primary transfer rollers 83Y, 83M, 83C, and 83K, which are provided inside the loop of the intermediate transfer belt 66. Further, the intermediate transfer belt 66 is circularly moved in the counterclockwise direction in the drawing by the rotational force of the driving roller 17 driven to rotate in the counterclockwise direction by a driving device (not illustrated).

The four primary transfer rollers 83Y, 83M, 83C, and 83K and the photoconductor drums 22Y, 22M, 22C, and 22K sandwich the intermediate transfer belt 66 circularly moved as described above. With this configuration, primary transfer nip portions for the Y, M, C, and K colors are formed in which the outer surface of the intermediate transfer belt 66 is in contact with the respective surfaces of the photoconductor drums 22Y, 22M, 22C, and 22K.

Each of the primary transfer rollers 83Y, 83M, 83C, and 83K is applied with a primary transfer bias voltage by a transfer bias power supply (not illustrated). Thereby, a transfer electric field is formed between the photoconductor drums 22Y, 22M, 22C, and 22K and the primary transfer rollers 83Y, 83M, 83C, and 83K. The primary transfer rollers 83Y, 83M, 83C, and 83K may be replaced by, for example, transfer chargers or transfer brushes.

Along with the rotation of the photoconductor drum 22Y, the Y toner image formed on the surface of the photoconductor drum 22Y in the process cartridge 5Y for the Y color enters into the above-described primary transfer nip portion for the Y color. Then, due to the action of the transfer electric field and the nip pressure, the Y toner image is transferred from the photoconductor drum 22Y onto the intermediate transfer belt 66. That is, the primary transfer process is performed. The intermediate transfer belt 66 carrying the Y toner image transferred thereon as described above in the primary transfer process sequentially passes through the primary transfer nip portions for the M, C, and K colors, along with the circular movement thereof. In this process, the primary transfer process of the M toner image, the C toner image, and the K toner image on the photoconductor drums 22M, 22C, and 22K is performed, i.e., the M toner image, the C toner image, and the K toner image are sequentially superimposed and transferred onto the Y toner image. With this primary transfer process for superimposing the respective toner images, a four-color toner image is formed on the intermediate transfer belt 66.

The secondary transfer roller 80 of the transfer unit 65 is provided outside the loop of the intermediate transfer belt 66 such that the secondary transfer roller 80 and the driven roller 69 provided inside the loop sandwich the intermediate transfer belt 66. With this configuration, a secondary transfer nip portion is formed in which the outer surface of the intermediate transfer belt 66 is in contact with the secondary transfer roller 80. The secondary transfer roller 80 is applied with a secondary transfer bias voltage by a transfer bias power supply (not illustrated). With the bias voltage thus applied, a secondary transfer electric field is formed between the secondary transfer roller 80 and the driven roller 69 connected to the ground.

At a position vertically below the transfer unit 65, the sheet feeding cassette 84 is provided to be slidingly attachable to and detachable from the housing of the printer 100. The sheet feeding cassette 84 stores a sheet stack including a plurality of stacked recording sheets (i.e., recording media) P. The sheet feeding cassette 84 has the recording sheet P on the top surface of the sheet stack brought into contact with a sheet feeding roller 85. When the sheet feeding roller 85 is rotated in the counterclockwise direction in the drawing at predetermined timing, the recording sheet P is sent out to a sheet feeding path 86.

At a position near the end of the sheet feeding path 86, a registration roller pair 87 is provided. Immediately after the rollers of the registration roller pair 87 nip the recording sheet P sent out from the sheet feeding cassette 84, the rotation of the both rollers is stopped. Then, the rotational driving of the rollers is restarted to send the recording sheet P to the secondary transfer nip portion at appropriate timing for making the nipped recording sheet P aligned with the four-color toner image on the intermediate transfer belt 66 in the above-described secondary transfer nip portion.

The four-color toner image on the intermediate transfer belt 66 brought into close contact with the recording sheet P in the secondary transfer nip portion is transferred onto the recording sheet P at one time, i.e., a secondary transfer process is performed, due to the action of the secondary transfer electric field and the nip pressure. Thereby, the four-color toner image on the white color of the recording sheet P forms a full-color toner image. The recording sheet P carrying the full-color toner image formed on a surface thereof as described above passes through the secondary transfer nip portion, and curvature separation of the recording sheet P from the secondary transfer roller 80 and the intermediate transfer belt 66 occurs. Then, the recording sheet P is sent to the fixing unit 34 described later through a post-transfer conveying path 88.

The intermediate transfer belt 66 having passed through the secondary transfer nip portion has post-transfer residual toner adhering thereto without being transferred to the recording sheet P. The post-transfer residual toner is cleaned by the belt cleaning device 81 which is in contact with the outer surface of the intermediate transfer belt 66. The cleaning backup roller 82 provided inside the loop of the intermediate transfer belt 66 backs up, from the inside of the loop, the cleaning of the intermediate transfer belt 66 by the belt cleaning device 81.

In the fixing unit 34, a fixing roller 34*a* and a pressure roller 34*b* form a fixing nip portion. The fixing roller 34*a* includes therein a heat generating source such as a halogen lamp (not illustrated). The pressure roller 34*b* is rotated while being brought into contact with the fixing roller 34*a* by predetermined pressure. The recording sheet P sent into the fixing unit 34 is nipped in the fixing nip portion such that the surface of the recording sheet P carrying thereon the unfixed toner image is brought into close contact with the fixing roller 34*a*. Then, the toner in the toner image is softened by the heat and pressure applied thereto. Thereby, the full-color image is fixed on the recording sheet P.

The recording sheet P discharged from the fixing unit 34 passes through a post-fixing conveying path 89, and reaches a point at which the post-fixing conveying path 89 branches into a sheet discharging path 90 and a reversing and forward conveying path 41. On one side of the post-fixing conveying path 89, a switch plate 42 is provided which is driven to rotate around a rotary shaft 42*a*. In accordance with the rotation of the switch plate 42, an end portion of the post-fixing conveying path 89 is opened or closed. When the recording sheet P is set out from the fixing unit 34, the switch plate 42 is stopped at a rotation position indicated by the corresponding solid line in the drawing to open the end portion of the post-fixing conveying path 89. Thereby, the recording sheet P from the post-fixing conveying path 89 enters into the sheet discharging path 90, and is nipped between rollers of a sheet discharging roller pair 91.

If a single-side print mode is set by, for example, an input operation performed on an operation unit including numeric keys and so forth (not illustrated) or a control signal transmitted from a personal computer or the like (not illustrated), the recording sheet P nipped by the sheet discharging roller pair 91 is directly discharged outside the printer 100. Then, the recording sheet P is stacked on a sheet stacking portion formed by the upper surface of the upper cover 50 of the housing of the printer 100.

Meanwhile, if a double-side print mode is set, the recording sheet P is conveyed through the sheet discharging path 90 with the leading end thereof nipped by the sheet discharging roller pair 91. Then, when the rear end of the recording sheet P passes through the post-fixing conveying path 89, the switch plate 42 is rotated to the position indicated by the corresponding broken line in the drawing to close the end portion of the post-fixing conveying path 89. Almost at the same time, the sheet discharging roller pair 91 starts to be rotated in the reverse direction. Then, the recording sheet P is conveyed with the rear end thereof being the leading side this time, and is entered into the reversing and forward conveying path 41.

FIG. 1 illustrates the front side of the printer 100 of the exemplary embodiment. The near side in the direction perpendicular to the drawing plane corresponds to the front side of the printer 100, and the far side in the perpendicular direction corresponds to the rear side of the printer 100. Further, the right side in the drawing corresponds to the right side of the printer 100, and the left side in the drawing corresponds to the left side of the printer 100. A right end portion of the printer 100 forms the reversing unit 40 which can be opened and closed with respect to the body of the printer housing in accordance with the rotational movement of the reversing unit 40 around a rotary shaft 40*a*. When the rollers of the sheet discharging roller pair 91 are rotated in the reverse direction, the recording sheet P enters into the reversing and forward conveying path 41 of the reversing unit 40, and is conveyed vertically from the upper side to the lower side. Then, the recording sheet P passes through rollers of a reverse conveying roller pair 43 and enters into a reverse conveying path 44 curved into a semicircular shape. Further, with the recording sheet P conveyed along the curved shape of the reverse conveying path 44, the upper surface and the lower surface of the recording sheet P are reversed. At the same time, the vertical moving direction of the recording sheet P from the upper side to the lower side is also revered, i.e., the recording sheet P is vertically conveyed from the lower side to the upper side. Thereafter, the recording sheet P reenters into the secondary transfer nip portion through the above-described sheet feeding path 86. Then, also on the other surface of the recording sheet P, a full-color image is transferred at one time in the secondary transfer process. Thereafter, the recording sheet P sequentially passes through the post-transfer conveying path 88, the fixing unit 34, the post-fixing conveying path 89, the sheet discharging path 90, and the sheet discharging roller pair 91, and is discharged outside the printer 100.

The above-described reversing unit 40 includes an outer cover 45 and a swing portion 46. Specifically, the outer cover 45 of the reversing unit 40 is supported to be rotatable around the rotary shaft 40*a* provided to the housing of the printer body. With this rotation, the outer cover 45 and the swing portion 46 held therein are opened and closed with respect to the housing. As indicated by the corresponding broken lines in the drawing, when the outer cover 45 and the swing portion 46 held therein are opened, the sheet feeding path 86, the secondary transfer nip portion, the post-transfer conveying path 88, the fixing nip portion, the post-fixing conveying path 89, and the sheet discharging path 90, which are formed between the reversing unit 40 and the printer body, are vertically halved and exposed to the outside. Thereby, the recording sheet P jammed in the sheet feeding path 86, the secondary transfer nip portion, the post-transfer conveying path 88, the fixing nip portion, the post-fixing conveying path 89, or the sheet discharging path 90 can be easily removed.

Further, in the open state of the outer cover 45, the swing portion 46 is supported by the outer cover 45 to be rotatable around a swing shaft (not illustrated) provided to the outer cover 45. With this rotation, when the swing portion 46 is opened with respect to the outer cover 45, the reversing and forward conveying path 41 and the reverse conveying path 44 are vertically halved and exposed to the outside. Thereby, the recording sheet P jammed in the reversing and forward conveying path 41 or the reverse conveying path 44 can be easily removed.

The upper cover 50 of the printer housing is supported to be rotatable around a shaft member 51, as indicated by the corresponding arrows in the drawing. Rotated in the counterclockwise direction in the drawing, the upper cover 50 is opened with respect to the printer housing, and an upper opening of the printer housing is widely exposed. Further, the wiring device 70 is rotatable together with the upper cover 50. Therefore, with the upper cover 50 opened with respect to the printer housing, the writing device 70 is moved outside the printer 100, and the development units 2K, 2C, 2M, and 2Y (alternatively referred to collectively as the development units 2) can be ejected upward from the printer 100. Further, with the upper cover 50 opened with respect to the printer housing, the development units 2 are installed in the printer 100.

Figure 2:
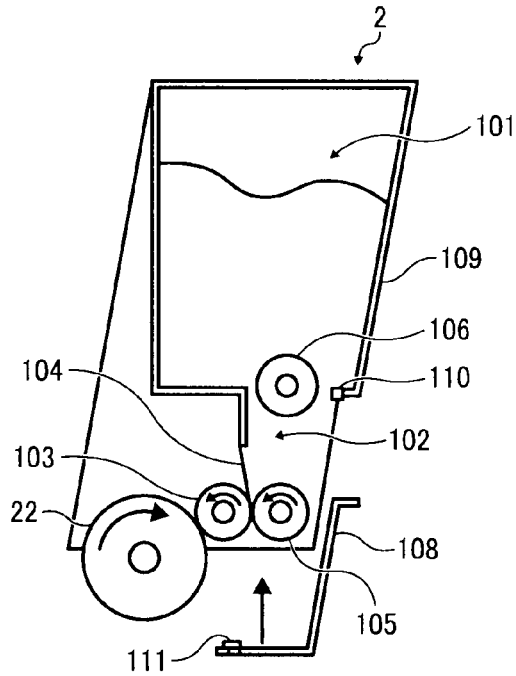
FIG. 2 is a schematic configuration diagram of a cross section of a development unit according to a first configuration example.

First Configuration Example: FIG. 2 illustrates a cross-sectional view of the development unit 2 in the present configuration example. The development unit 2 includes a toner storing chamber 101, a toner supplying chamber 102, a development roller 103, a layer controlling member 104, a supply roller 105, a toner conveying member 106, a metal cover 108, a resin cover 109, sponge members 110 and 111, and so forth.

The toner storing chamber 101 stores toner. The toner supplying chamber 102 is provided under the toner storing chamber 101. The layer controlling member 104 is provided to be in contact with the development roller 103 to control the thickness of a toner layer (i.e., the amount of the toner) on the development roller 103. The supply roller 105 supplies the development roller 103 with the toner in the toner supplying chamber 102.

The outer wall of the development unit 2 is basically formed by the resin cover 109. However, a bottom portion of the toner supplying chamber 102 and a side portion of the outer wall parallel to the axial direction of the supply roller 105 are formed by the metal cover 108. Further, to prevent the toner from leaking from a gap formed between the resin cover 109 and the metal cover 108, the sponge member 110 is provided to an adjacent portion in which the resin cover 109 and the metal cover 108 are adjacent to each other. With the sponge member 110 in the adjacent portion pressed to seal the gap, the toner leakage from between the resin cover 109 and the metal cover 108 can be prevented.

The toner conveying member 106 provided in the toner storing chamber 101 is formed into a blade-like plate capable of applying mixing force and conveying force to the toner. The toner conveying member 106 is provided in the development unit 2 to convey the toner in the toner storing chamber 101 to the toner supplying chamber 102 through a toner supply port.

The supply roller 105 rotated in the counterclockwise direction in the drawing carries thereon the toner in the toner supplying chamber 102 by having the toner efficiently adhere thereto, and supplies the toner adhering to the surface thereof to the surface of the development roller 103 such that the surface of the development roller 103 is coated with the toner. The development roller 103 is also rotated in the counterclockwise direction in the drawing. After having passed a position facing the layer controlling member 104, the development roller 103 carries thereon the toner layer, the thickness of which has been controlled. Then, the development roller 103 conveys the thickness-controlled toner carried on the surface thereof to a development area facing the photoconductor drum 22. The development roller 103 and the photoconductor drum 22 are disposed to be in contact with each other. The development roller 103 is applied with a predetermined development bias voltage from a high-voltage power supply (not illustrated). Thereby, the toner on the development roller 103 adheres to the latent image formed on the photoconductor drum 22 in the development area, and the latent image is developed into a toner image.

Further, as illustrated in FIG. 2, the sponge member 111 is bonded with double-sided tape to a portion of the metal cover 108 corresponding to the development roller 103. With the sponge member 111 sealing a gap between the development roller 103 and the metal cover 108, toner leakage from the gap between the development roller 103 and the metal cover 108 is prevented.

In the development unit 2 of the present configuration example, the supply roller 105 and the development roller 103 are in contact with each other. Therefore, a nip portion is formed in which the toner is supplied from the supply roller 105 to the development roller 103 to coat the surface of the development roller 103 with the toner. In the nip portion, the rotation direction of the supply roller 105 and the rotation direction of the development roller 103 are reverse to each other. In the nip portion, therefore, the supply roller 105 and the development roller 103 rub against each other, and thus frictional heat is generated. Due to the frictional heat, the temperature of the toner near the supply roller 105 and the development roller 103 is increased. It is generally known that, when the toner temperature exceeds approximately 45 degrees Celsius, an image defect is caused by toner fusion.

As described above, in the present configuration example, the outer wall of the toner supplying chamber 102 is formed by the metal cover 108 higher in thermal conductivity than the resin cover 109. With this configuration, the heat of the toner increased in temperature by the frictional heat can be released outside the development unit 2 via the metal cover 108. Accordingly, it is possible to suppress an increase in temperature of the toner near the supply roller 105 and the development roller 103.

Figure 3:
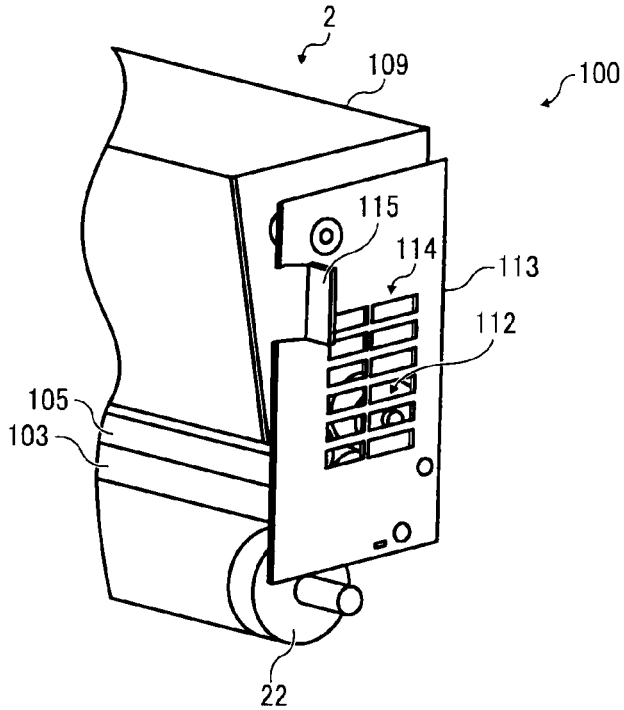
FIG. 3 is a perspective view of the development unit, wherein a metal plate serving as a heat releasing device is attached to the outer side of a toner supplying chamber in the axial direction of a development roller, on which a gear train is provided.
Figure 4:
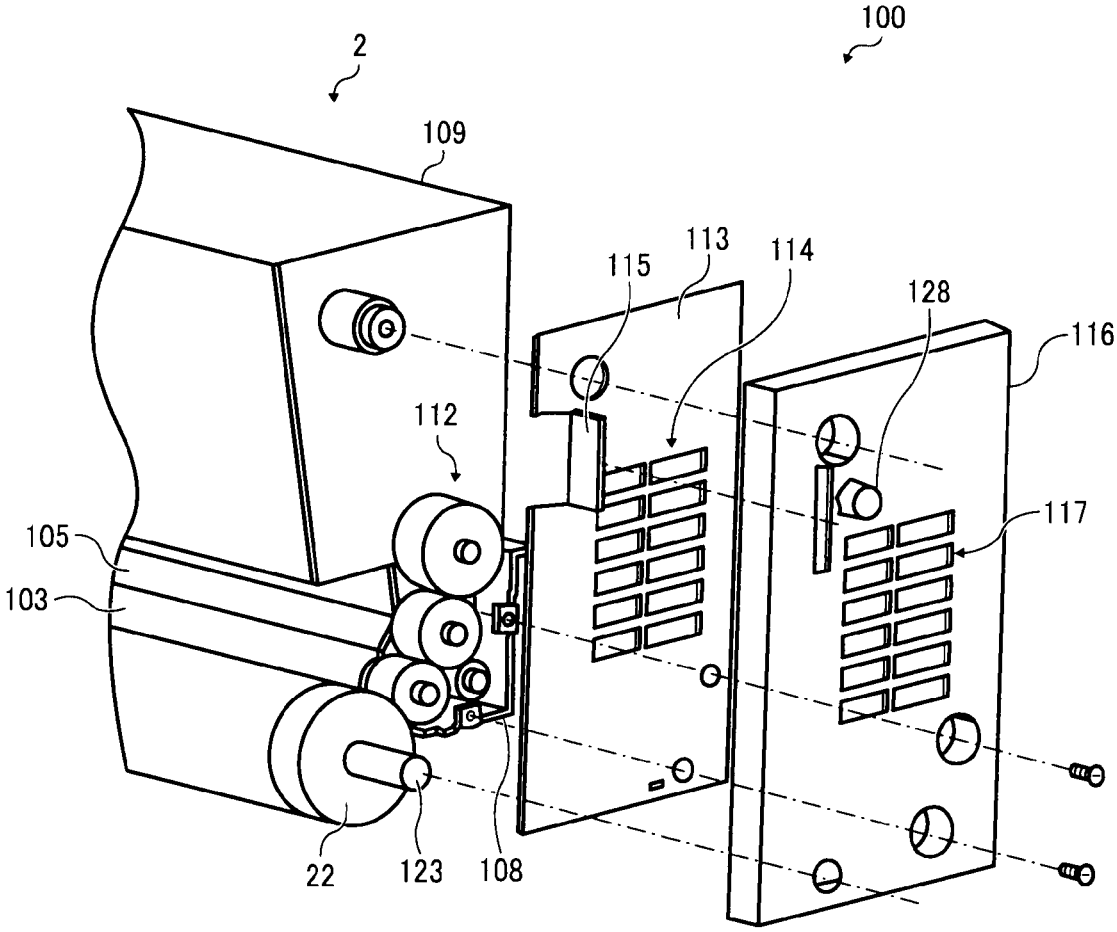
FIG. 4 is a perspective view of the development unit according to the first configuration example, wherein the metal plate serving as the heat releasing device and a resin side plate for covering the metal plate are provided to the outer side of the toner supplying chamber in the axial direction of the development roller, on which the gear train is provided.

Further, in the present configuration example, to increase the heat release efficiency of the heat conducted from the toner in the toner supplying chamber 102 to the metal cover 108, a metal plate 113 as illustrated in FIG. 3, which is a plate-like heat sink serving as a heat releasing device, is provided at a position outside one side of the outer wall of the development unit 2 in the axial direction of the development roller 103, on which a gear train 112 is provided. As illustrated in FIG. 4, at the position outside the one side of the outer wall of the development unit 2 in the axial direction of the development roller 103, on which the gear train 112 is provided, the metal plate 113 is fixed by screws to the metal cover 108 at respective positions at which parts of the metal plate 113 come into contact with the corresponding parts of the metal cover 108. With this configuration, the heat in the toner supplying chamber 102 conducted to the metal cover 108 is conducted from the metal cover 108 to the metal plate 113, and thus can be efficiently released from the metal plate 113. Accordingly, it is possible to suppress the increase in temperature of the toner in the toner supplying chamber 102 more than in a configuration which releases the heat in the toner supplying chamber 102 solely by the use of the metal cover 108.

In the body of the printer 100 including the development unit 2 and other devices disposed along the surface of the photoconductor drum 22 carrying the latent image, as in the printer 100 according to the exemplary embodiment, the space is less limited in the periphery outside the toner supplying chamber 102 (i.e., the development unit 2) in the axial direction of the development roller 103 than in the periphery inside the toner supplying chamber 102 (i.e., the development unit 2) in the axial direction of the development roller 103. Therefore, the heat releasing device such as the metal plate 113 is provided on at least one of the outer sides of the toner supplying chamber 102 (i.e., the development unit 2) in the axial direction of the development roller 103, as in the present configuration example. With this configuration, it is possible to provide, in the printer body, the development unit 2 including the heat releasing device, while reducing the limitation in layout inside the printer body.

The gear train 112 provided to the development unit 2 is a drive force transmission device for transmitting drive force from a drive source (not illustrated), which is provided to the printer body to drive the development roller 103 and the supply roller 105 of the development unit 2 and so forth, to the development roller 103, the supply roller 105, and so forth via a plurality of gears. When the gear train 112 transmits the drive force from the drive source to the development roller 103, the supply roller 105, and so forth, the respective gears slide against one another. As a result, sliding heat is generated. The sliding heat thus generated in the gear train 112 heats the toner near the gear train 112 across the outer wall of the toner supplying chamber 102, and the temperature of the toner is increased. In view of this, the metal plate 113 is provided on the outer side of the toner supplying chamber 102 in the axial direction of the development roller 103 provided with the gear train 112 such that the metal plate 113 can efficiently release the sliding heat generated in the gear train 112, as in the development unit 2 of the present configuration example. With this configuration, it is possible to suppress the increase in temperature of the toner due to the sliding heat generated in the gear train 112.

For efficient heat transmission from the metal cover 108 to the metal plate 113, a reduction in thermal contact resistance between the metal cover 108 and the metal plate 113 is effective. Specifically, the thermal contact resistance can be reduced by, for example, increasing the number of screws used to fix the metal cover 108 and the metal plate 113 to each other, increasing the area in which the metal cover 108 and the metal plate 113 are in contact with each other, and applying thermally conductive silicon grease to the contact surface of the metal cover 108 and the metal plate 113.

Further, if the surface area of the metal plate 113 is increased, the heat release efficiency of the metal plate 113 can be improved. Specifically, it is possible to increase the surface area of the metal plate 113 and thus improve the heat release efficiency of the metal plate 113 by, for example, providing the metal plate 113 with holes 114, increasing at least one of the height, the width, and the thickness of the metal plate 113, or adding a bent portion 115 to the metal plate 113. When the holes 114 are provided to increase the surface area of the metal plate 113, the holes 114 may not be completely cut out of the metal plate 113, but may be formed by portions of the metal plate 113 corresponding to the holes 114 bent toward, for example, the development unit 2 with one side of each of the holes 114 connecting to the metal plate 113.

Figure 5:
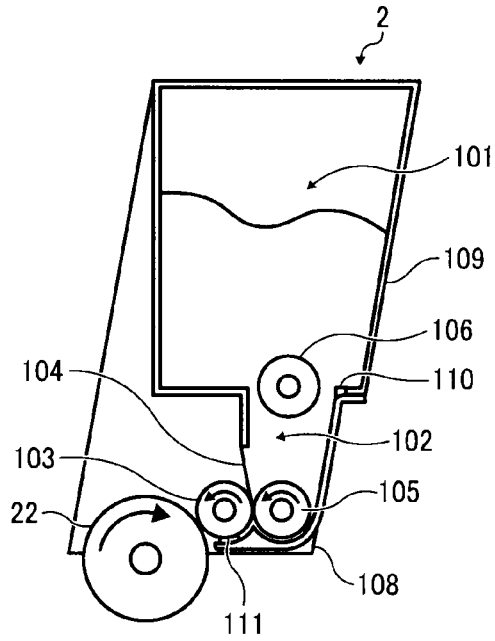
FIG. 5 is a schematic configuration diagram of a cross section of the development unit, wherein a portion of a metal cover facing a nip portion in which the development roller and a supply roller are in contact with each other is increased in thickness.

It is preferable to form the metal cover 108 and the metal plate 113, which receive the heat conducted from the toner in the toner supplying chamber 102 and release the heat, by using a metal material having a high thermal conductivity, such as aluminum. Further, if the thickness of the metal cover 108 or the metal plate 113 is increased, the heat transmission is promoted, and thus the heat release efficiency can be improved. Particularly, as illustrated in FIG. 5, if the metal cover 108 is formed into a shape fitting the outer circumference of the supply roller 105 and the development roller 103, and if a portion of the metal cover 108 facing the nip portion formed by the supply roller 105 and the development roller 103 is increased in thickness, the heat of the toner heated by the frictional heat is easily transmitted to the metal cover 108. As a result, the effect of suppressing the increase in temperature of the toner can be improved. Even with one of the above-described configurations, i.e., the metal cover 108 formed into the shape fitting the outer circumference of the supply roller 105 and the development roller 103 or the metal cover 108 having the thick portion facing the nip portion formed by the supply roller 105 and the development roller 103, the heat of the toner heated by the frictional heat is easily transmitted to the metal cover 108, and thus the effect of suppressing the increase in temperature of the toner can be improved.

Figure 6:
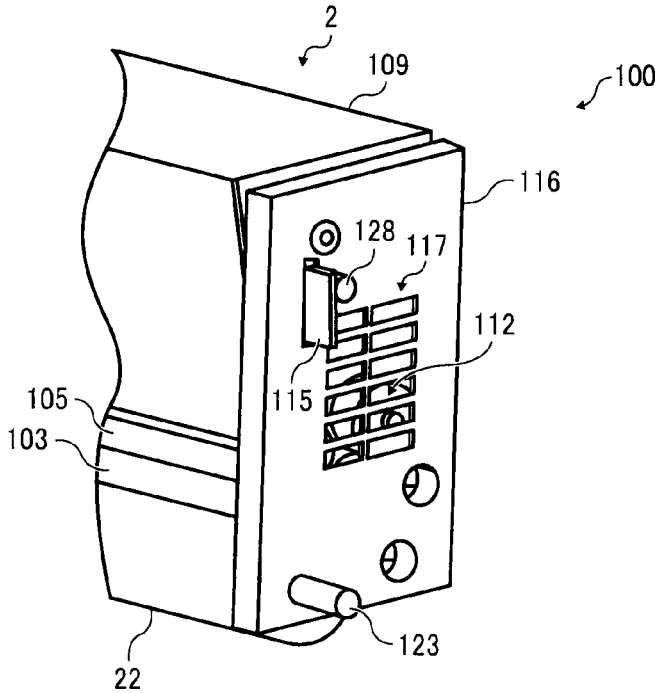
FIG. 6 is a perspective view of the development unit, wherein the metal plate serving as the heat releasing device and the resin side plate for covering the metal plate are attached to the outer side of the toner supplying chamber in the axial direction of the development roller, on which the gear train is provided.

Further, in the development unit 2 of the present configuration example, the outer side of the metal plate 113 is covered by a resin side plate 116, as illustrated in FIGS. 4 and 6. If the metal plate 113 of the development unit 2 is hot when the process cartridge 5 integrated with the development unit 2 and so forth is ejected outside the printer 100, a user during the ejection may touch the metal plate 113 and get burned. In view of this, the outer side of the metal plate 113 is covered by the resin side plate 116, as in the development unit 2 of the present configuration example. With this configuration, it is possible to prevent the user from touching the hot metal plate 113 and getting burned. Therefore, the improvement in safety is achieved. Further, it is possible to suppress the exposure of the metal plate 113, and thus to improve the appearance of the development unit 2.

Further, in a configuration in which the resin side plate 116 covers the metal plate 113, as in the present configuration example, holes 117 are provided to the resin side plate 116. With this configuration, the air around the metal plate 113 is easily circulated through the holes 117, and thus the heat release efficiency of the metal plate 113 can be improved. In the present configuration example, the holes 117 are formed as horizontally long holes. Alternatively, the holes 117 may be formed as vertically long holes, square holes, or circular holes, for example. In any of the cases, effects similar to the above-described effects can be obtained.

Further, although not illustrated, not only the outer side of the metal plate 113 but also the outer side of the metal cover 108 may also be covered by a resin cover similar to the resin side plate 116. With this configuration, effects similar to the above-described effects of the resin side plate 116 covering the metal plate 113 can be obtained.

Figure 7:
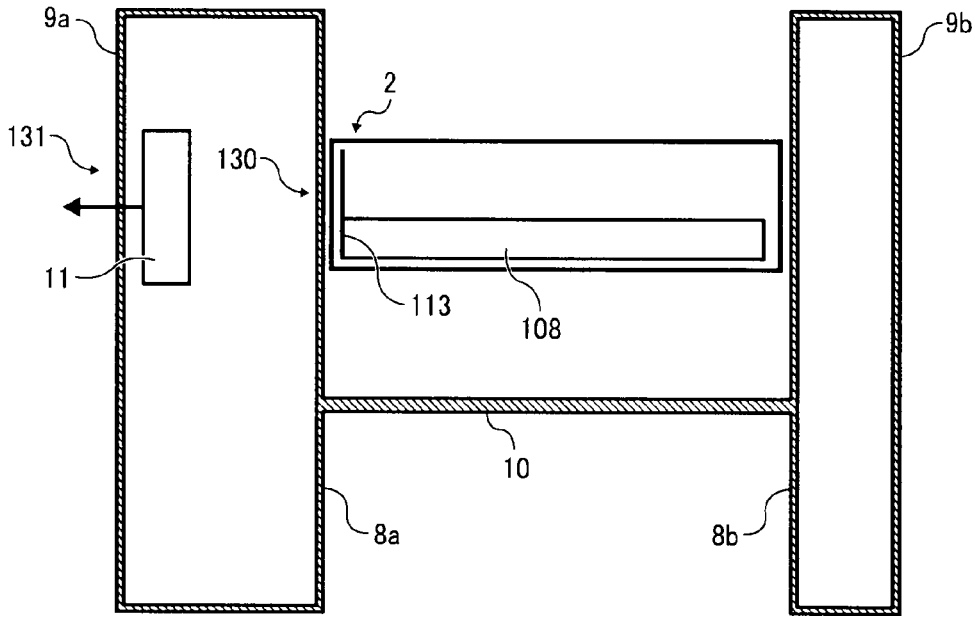
FIG. 7 is a schematic diagram of the printer illustrating a positional relationship of body frames, body covers, a base frame, the development unit, the metal cover, the metal plate, a fan motor, and so forth.

FIG. 7 illustrates a positional relationship of a left body frame 8*a*, a right body frame 8*b*, a left body cover 9*a*, a right body cover 9*b*, a base frame 10, the development unit 2, the metal cover 108, the metal plate 113, a fan motor 11, and air holes 130 and 131 in the printer 100 of the present configuration example.

The left body frame 8*a* and the right body frame 8*b* are formed by planar surfaces substantially perpendicular to the longitudinal direction of the development unit 2. The fan motor 11 is provided in a housing formed by the left body frame 8*a*, the left body cover 9*a*, and so forth. The air holes 130 and 131 are opened in the left body frame 8*a* and the left body cover 9*a*, respectively. The fan motor 11 generates an air current for discharging the gas in the printer 100 to the outside of the printer 100 through the air hole 131 in the left body cover 9*a*. Accordingly, the gas around the development unit 2 heated by the heat released from the metal cover 108 and the metal plate 113 of the development unit 2 can be efficiently discharged to the outside of the printer 100 through the air holes 130 and 131 opened in the left body frame 8*a* and the left body cover 9*a*, respectively.

Figure 8:
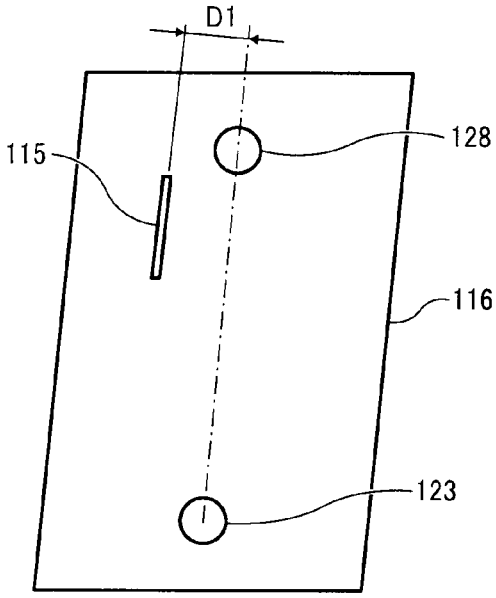
FIG. 8 is a schematic diagram illustrating a positional relationship of a bent portion of the metal plate and a virtual straight line passing through the axial center of a shaft of a photoconductor and the axial center of a convex portion projecting from the resin side plate.

When the metal plate 113 and the resin side plate 116 are attached to the outer side of the development unit 2 in the axial direction of the development roller 103 provided with the gear train 112, as illustrated in FIG. 4, a shaft 123 and the bent portion 115 of the metal plate 113 project from the resin side plate 116 of the development unit 2 through holes opened in the resin side plate 116, as illustrated in FIG. 6. The shaft 123 is a shaft of the photoconductor drum 22 integrated with the development unit 2 to form the process cartridge 5. Further, the metal plate 113 and the resin side plate 116 are configured such that the shortest distance D1 illustrated in FIG. 8 between the bent portion 115 and a vertical straight line passing through the axial center of the shaft 123 and the axial center of a convex portion 128 formed on the resin side plate 116 is different among the respective development units 2. The shortest distances D1 for the development units 2Y, 2M, 2C, and 2K are represented as variables D1Y, DIM, D1C, and D1K, respectively.

Figure 9:
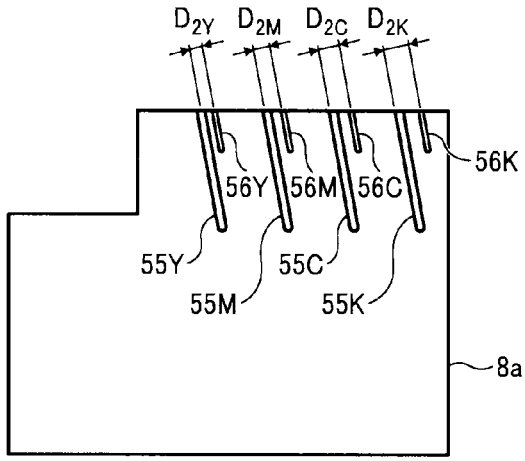
FIG. 9 is a schematic diagram of a left body frame, as viewed in the axial direction of the development roller of the development unit in the printer.

FIG. 9 illustrates a schematic diagram of the left body frame 8*a*, as viewed in the axial direction (i.e., longitudinal direction) of the development roller 103 of each of the development units 2 in the printer 100. The left body frame 8*a* is provided with guide grooves 55 and 56, i.e., guide grooves 55Y, 55M, 55C, and 55K and guide grooves 56Y, 56M, 56C, and 56K. Each of the guide grooves 55Y, 55M, 55C, and 55K guides the shaft 123 of the photoconductor drum 22 and the convex portion 128 projecting from the resin side plate 116 provided to the corresponding one of the development units 2Y, 2M, 2C, and 2K. Further, each of the guide grooves 56Y, 56M, 56C, and 56K guides the bent portion 115 of the metal plate 113 projecting from the resin side plate 116 provided to the corresponding one of the development units 2Y, 2M, 2C, and 2K. That is, the left body frame Ba is provided with the guide grooves 55Y and 56Y corresponding to the development unit 2Y, the guide grooves 55M and 56M corresponding to the development unit 2M, the guide grooves 55C and 56C corresponding to the development unit 2C, and the guide grooves 55K and 56K corresponding to the development unit 2K.

Further, the distance between the guide grooves 55 and 56 is different among the development units 2. The distance between the guide grooves 55Y and 56Y, the distance between the guide grooves 55M and 56M, the distance between the guide grooves 55C and 56C, and the distance between the guide grooves 55K and 56K are represented as variables D2Y, D2M, D2C, and D2K, respectively.

In the present configuration example, the correspondence between the distance variables DIY, DIM, D1C, and DIK and the distance variables D2Y, D2M, D2C, and D2K is illustrated in TABLE 1.

TABLE 1

| DISTANCE $D_{1Y}$ DISTANCE $D_{2Y}$ | DISTANCE $D_{1M}$ DISTANCE $D_{2M}$ | DISTANCE $D_{1C}$ DISTANCE $D_{2C}$ | DISTANCE $D_{1K}$ DISTANCE $D_{2K}$ |
|---|---|---|---|
| 10 mm | 13 mm | 16 mm | 19 mm |

In the installment of the development units 2 into the printer body, therefore, each of the grooves 55 and 56 allows only the corresponding development unit 2 to be installed therein. Therefore, it is possible to prevent incorrect installation of the development units 2 by a user, and thus to prevent incorrect installation of the process cartridges 5. Further, the metal plate 113 can be effectively used as a member for preventing the incorrect installation. Therefore, the cost is lower in this configuration than in a configuration in which a member for preventing the incorrect installation is separately provided.

Figure 10:
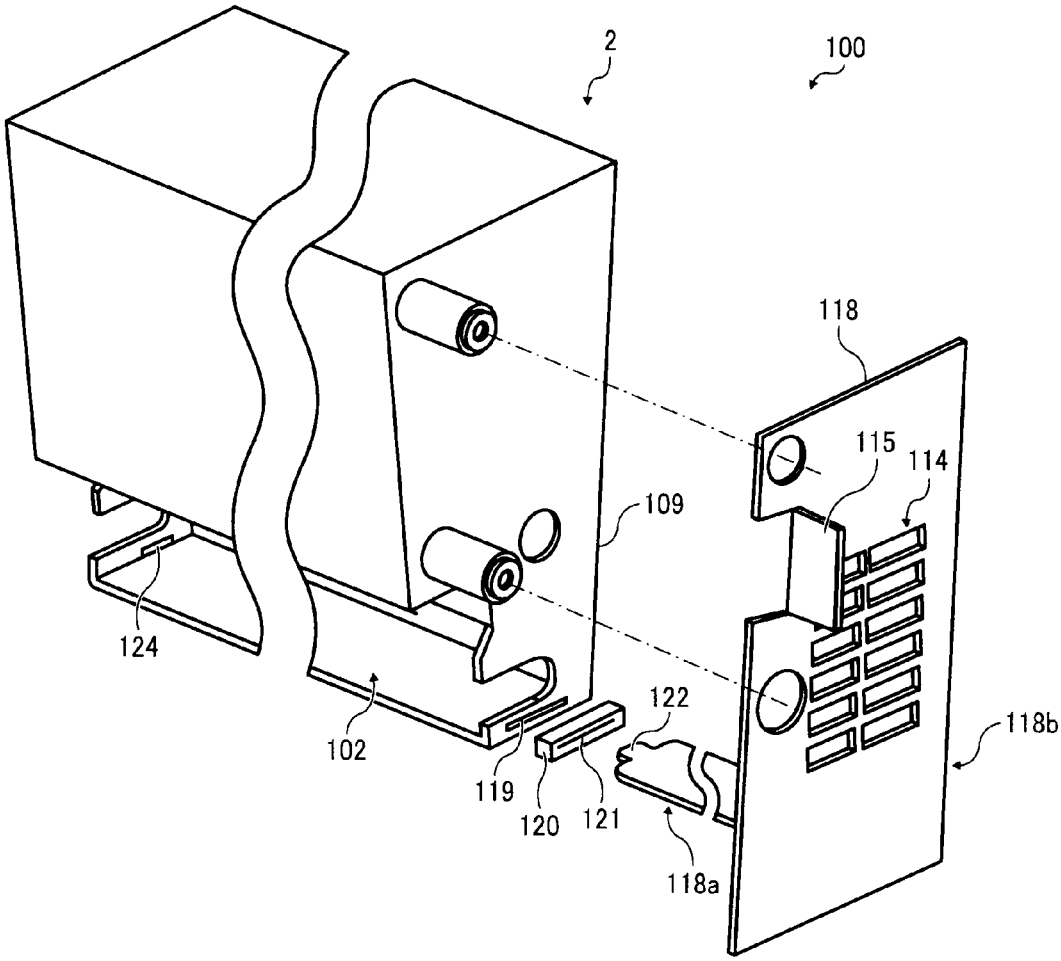
FIG. 10 is a perspective view of a development unit according to a second configuration example.

Second Configuration Example: The development unit 2 of the present configuration example is configured to include a metal plate 118 as illustrated in FIG. 10, which integrates the metal cover 108 and the metal plate 113 described in the first configuration example. The metal plate 118 is formed by a heat conduction portion 118*a* for receiving the heat conducted from the toner in the toner supplying chamber 102, and a heat release portion 118*b* for releasing the heat conducted from the toner to the outside of the toner supplying chamber 102.

The outer wall of the development unit 2 of the present configuration example is formed by the resin cover 109. The resin cover 109 is provided with an insertion hole 119 opened therein to allow the heat conduction portion 118*a* of the metal plate 118 to be inserted into the toner supplying chamber 102.

In the assembly of the development unit 2, a sponge member 120 is first bonded with double-sided tape to an edge portion of the outer side of the resin cover 109 corresponding to the insertion hole 119. The sponge member 120 is provided with a slit 121 piercing through the sponge member 120 in the thickness direction thereof. To attach the sponge member 120 to the resin cover 109, the insertion hole 119 of the resin cover 109 and the slit 121 of the sponge member 120 are aligned to communicate with each other. Then, the heat conduction portion 118*a* of the metal plate 118 is sequentially inserted into the slit 121 of the sponge member 120 and the insertion hole 119 of the resin cover 109. The heat conduction portion 118*a* of the metal plate 118 is inserted into the toner supplying chamber 102 until the sponge member 120 and a surface of the heat release portion 118*b* of the metal plate 118 facing the toner supplying chamber 102 come into close contact with each other. Thereby, the sponge member 120 functions as a sealing device for sealing the insertion hole 119, and toner leakage from the insertion hole 119 can be prevented. The leading end of the heat conduction portion 118*a* of the metal plate 118 inserted into the slit 121 and the insertion hole 119 has a convex portion 122. If the heat conduction portion 118*a* of the metal plate 118 inserted in the slit 121 and the insertion hole 119 is further inserted toward the other side of the resin cover 109 opposite to the side formed with the insertion hole 119, the convex portion 122 of heat conduction portion 118*a* of the metal plate 118 fits in a concave portion 124 provided in the other side of the resin cover 109. The concave portion 124 has a clearance in the width direction and the length direction of the convex portion 122, and has a function of regulating the position of the metal plate 118 in the height direction thereof.

In the development unit 2 of the present configuration example, the heat of the toner in the toner supplying chamber 102 having the outer wall entirely formed by the resin cover 109 is conducted to the heat conduction portion 118*a* of the metal plate 118 in the toner supplying chamber 102. Then, the heat conducted to the heat conduction portion 118*a* is released from the heat release portion 118*b* of the metal plate 118 exposed outside the toner supplying chamber 102.

Further, with the use of the metal plate 118 integrating the heat conduction portion 118*a* for receiving the heat conducted from the toner in the toner supplying chamber 102 and the heat release portion 118*b* for releasing the heat conducted to the heat conduction portion 118*a* to the outside of the toner supplying chamber 102, as in the present configuration example, it is possible to similarly obtain the heat release effect of the metal cover 108 and the metal plate 113 as described in the first configuration example, while reducing the costs of the components.

Further, also in the present configuration example, in which the heat release portion 118*b* of the metal plate 118 is provided on at least one of the outer sides of the toner supplying chamber 102 (i.e., the development unit 2) in the axial direction of the development roller 103, it is possible to provide the development unit 2 in the printer body, while reducing the limitation in layout inside the printer body.

As described above, the printer 100 according to the exemplary embodiment serves as an image forming apparatus including the photoconductor drum 22 serving as an image carrying member for carrying a latent image on a surface thereof and the development unit 2 serving as a development device disposed along the surface of the photoconductor drum 22. The development unit 2 includes the toner supplying chamber 102, the development roller 103, and the supply roller 105. The toner supplying chamber 102 serves as a developer storing case for storing a developer (i.e., toner).

The development roller 103 serves as a developer carrying member for carrying, on a surface thereof, the developer stored in the toner supplying chamber 102. The supply roller 105 serves as a developer supplying member for supplying the development roller 103 with the developer stored in the toner supplying chamber 102. In an area in which the surface of the photoconductor drum 22 faces the surface of the development roller 103, the printer 100 develops the latent image carried on the surface of the photoconductor drum 22 by using the developer carried on the surface of the development roller 103. The development unit 2 further includes the metal cover 108 and the metal plate 113. The metal cover 108 is a metal member extending in the axial direction of the development roller 103 and receiving the heat conducted from the developer in the toner supplying chamber 102. The metal plate 113 serves as a heat releasing device which is provided on at least one of the outer sides of the toner supplying chamber 102 in the axial direction of the development roller 103 to be in contact with the metal cover 108 and release the heat conducted from the metal cover 108. As described above, with this configuration, it is possible to provide, in printer body, the development unit 2 including the metal plate 113 serving as the heat releasing device, while reducing the limitation in layout inside the printer body.

Further, in the exemplary embodiment, the metal cover 108 may be provided at a position facing at least one of the development roller 103 and the supply roller 105, with a predetermined distance interposed between the metal cover 108 and the at least one of the development roller 103 and the supply roller 105. With this configuration, the heat of the toner near the development roller 103 and the supply roller 105 generated by the mixing motion of the development roller 103 and the supply roller 105 can be efficiently conducted to the metal plate 113.

Further, in the exemplary embodiment, the metal cover 108 may form at least a part of the outer wall of the toner supplying chamber 102. With this configuration, it is possible to release the heat of the toner in the toner supplying chamber 102 with a simple configuration. It is also possible to reduce the number of components, and thus to reduce the cost and size of the development unit 2.

Further, in the exemplary embodiment, the metal cover 108 may be formed into a shape fitting the outer shape of at least one of the development roller 103 and the supply roller 105. With this configuration, the heat of the toner near the development roller 103 and the supply roller 105 is easily conducted to the metal cover 108, and the effect of suppressing the increase in temperature of the toner can be improved.

Further, in the exemplary embodiment, the development roller 103 and the supply roller 105 may be in contact with each other on the respective surfaces thereof, and the metal cover 108 may be provided at a position facing a nip portion in which the development roller 103 and the supply roller 105 are in contact with each other on the respective surfaces thereof. With this configuration, the heat of the toner heated by the sliding heat generated when the development roller 103 and the supply roller 105 slide against each other in the nip portion is easily conducted to the metal cover 108. Accordingly, the effect of suppressing the increase in temperature of the toner can be improved.

Further, in the exemplary embodiment, the metal cover 108 may be provided such that a relatively thick portion thereof faces at least the nip portion in which the development roller 103 and the supply roller 105 are in contact with each other. With this configuration, the heat of the toner heated by the sliding heat generated when the development roller 103 and the supply roller 105 slide against each other in the nip portion is easily conducted to the metal cover 108. Accordingly, the effect of suppressing the increase in temperature of the toner can be further improved.

Further, the exemplary embodiment may include a drive force transmission device which is provided on one of the outer sides of the toner supplying chamber 102 in the axial direction of the development roller 103, and which includes the gear train 112 for transmitting drive force to the development roller 103 and the supply roller 105 from a driving device for driving the development roller 103 and the supply roller 105. Further, the metal plate 113 may be provided on the outer side of the toner supplying chamber 102 in the axial direction of the development roller 103, on which the gear train 112 is provided. With this configuration, the sliding heat generated in the gear train 112 can be efficiently released by the metal plate 113. Accordingly, the increase in temperature of the toner due to the sliding heat in the gear train 112 can be reduced.

Further, in the exemplary embodiment, the metal plate 113 may be covered by the resin side plate 116, which is a resin cover having the holes 117. With this configuration, it is possible to prevent a user from touching the hot metal plate 113 and getting burned. Accordingly, the improvement in safety is achieved. Further, the exposure of the metal plate 113 is suppressed, and thus the appearance of the development unit 2 can be improved. Further, with the holes 117 provided to the resin side plate 116, the air around the metal plate 113 is easily circulated through the holes 117. Accordingly, the heat release efficiency of the metal plate 113 can be improved.

Further, the exemplary embodiment may include the left body frame 8*a* and the right body frame 8*b* as a pair of body frames facing each other in the axial direction of the development roller 103, with the development unit 2 interposed therebetween. Further, the fan motor 11 serving as an air current generation device for generating an air current may be provided to one of the left body frame 8*a* and the right body frame 8*b* on the side of the metal plate 113. With this configuration, the circulation of the air current around the metal plate 113 is improved. Accordingly, the heat release efficiency of the metal plate 113 can be improved.

Further, in the exemplary embodiment, the heat releasing device may form a heat sink such as the metal plate 113 or 118. This heat releasing device can reduce the size of the development unit 2 more than other existing heat releasing devices employing, for example, a water-cooling method.

Further, in the exemplary embodiment, the heat sink may be integrated with the metal cover 108 to form the metal plate 118. With this configuration, the costs of the components can be reduced.

Further, in the exemplary embodiment, the heat sink may include a metal plate such as the metal plate 113 or 118. This heat sink can suppress an increase in size of the development unit 2 more than an existing heat sink including fins or the like.

Further, in the exemplary embodiment, the heat sink (i.e., the metal plate 113 or 118) may be provided with the holes 114. With this configuration, the circulation of the air current around the heat sink is improved, and the heat release efficiency of the heat sink can be improved.

Further, in the exemplary embodiment, the heat sink (i.e., the metal plate 113 or 118) may be provided with the bent portion 115. With this configuration, it is possible to increase the surface area of the heat sink, and thus to improve the heat release efficiency of the heat sink.

Further, in the exemplary embodiment, the development unit 2 may be provided in a plurality to be attachable to and detachable from the printer 100. The development units 2 may be different in the color of toner sealed therein and in the bent portion 115 of the heat sink (i.e., the metal plate 113 or 118) thereof. Further, the left body frame 81 and the right body frame 8*b* may include the guide grooves 56, each of which is a groove allowing the installment of only the corresponding development unit 2 by allowing only the bent portion 115 of the corresponding development unit 2 to pass through the groove in the installment of the development units 2 into the printer body. With this configuration, the incorrect installation of the development units 2 by a user can be prevented with the use of the bent portion 115 of the heat sink formed to improve the heat release efficiency of the heat sink. Accordingly, it is unnecessary to separately provide a special member for preventing the incorrect installation, and thus a reduction in cost can be achieved.

The above-described exemplary embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the exemplary embodiments, such as the number, the position, and the shape, are not limited the exemplary embodiments and thus may be preferably set. It is therefore to be understood that within the scope of the appended claims, the disclosure of this patent specification may be practiced otherwise than as specifically described herein.

The invention claimed is:

1. An image forming apparatus, comprising:

an image carrying member that carries a latent image on a surface of the image carrying member; and a development device disposed along the surface of the image carrying member, the development device including a developer storing case that stores a developer;

at least one developer roller;

a metal member extending in an axial direction of the at least one developer roller and that receives heat conducted from the developer stored in the developer storing case, wherein the metal member forms at least a part of the developer storing case; and a heat releasing device disposed in contact with the metal member and that releases the heat conducted from the metal member, the heat releasing device provided on at least one outer side of the developer storing case in the axial direction of the at least one developer roller.

2. The image forming apparatus according to claim 1, wherein the development device further includes a resin cover having at least one hole formed therein, and the resin cover covers the heat releasing device.

3. The image forming apparatus according to claim 2, further comprising:

a sponge member that seals a gap between the metal member and the resin cover.

4. The image forming apparatus according to claim 1, further comprising:

a pair of body frames disposed facing each other in the axial direction of the at least one developer roller with the development device interposed between the pair of body frames; and an air current generation device that generates an air current and is provided to the pair of body frames which is disposed on the side of the heat releasing device.

5. The image forming apparatus according to claim 1, wherein the heat releasing device includes a heat sink.

6. The image forming apparatus according to claim 5, wherein the heat sink includes a metal plate.

7. The image forming apparatus according to claim 5, wherein the heat sink has at least one hole.

8. The image forming apparatus according to claim 5, wherein the heat sink includes a bent portion.

9. The image forming apparatus according to claim 1, further comprising:

a pair of body frames disposed facing each other in the axial direction of the at least one developer roller with the development device interposed between the pair of body frames, wherein the development device includes a plurality of detachably attachable development devices, the plurality of detachably attachable development devices each containing a different toner color and each having a corresponding bent portion that differs in shape and location, and wherein the pair of body frames includes one or more grooves each allowing installation of only one of the plurality of detachably attachable development devices by allowing only the corresponding bent portion to pass through each groove.

10. The image forming apparatus according to claim 1, wherein the at least one developer roller includes a developer carrying member that carries the developer on a surface of the developer carrying member to develop the latent image with the developer in an area in which the surface of the developer carrying member faces the surface of the image carrying member, and a developer supplying member that supplies the developer carrying member with the developer stored in the developer storing case.

11. The image forming apparatus according to claim 10, wherein the metal member is provided at a position facing at least one of the developer carrying member and the developer supplying member, with a predetermined distance interposed between the metal member and the at least one of the developer carrying member and the developer supplying member.

12. The image forming apparatus according to claim 10, wherein the metal member is shaped to fit the outer shape of at least one of the developer carrying member and the developer supplying member.

13. The image forming apparatus according to claim 10, wherein the metal member has a portion of enhanced thickness disposed facing at least a portion in which the developer carrying member and the developer supplying member are in contact with each other.

14. The image forming apparatus according to claim 10, further comprising:

a drive force transmission device provided on one outer side of the developer storing case in the axial direction of the at least one developer roller, the drive device force transmission device including a gear train which transmits drive force to the developer carrying member and the developer supplying member from a driving device driving the developer carrying member and the developer supplying member, wherein the heat releasing device is provided on the one outer side of the developer storing case in the axial direction of the at least one developer roller on which the drive force transmission device is provided.

15. The image forming apparatus according to claim 1, wherein a thermally conductive material is disposed between the heat releasing device and the metal member.

16. The image forming apparatus according to claim 15, wherein the thermally conductive material is thermally conductive silicon grease.

17. An image forming apparatus, comprising:

an image carrying member that carries a latent image on a surface of the image carrying member; and a development device disposed along the surface of the image carrying member, the development device including a developer storing case storing a developer;

a developer carrying member that carries the developer on a surface of the developer carrying member to develop the latent image with the developer in an area in which the surface of the developer carrying member faces the surface of the image carrying member;

a developer supplying member that supplies the developer carrying member with the developer stored in the developer storing case, wherein the developer carrying member and the developer supplying member are two roller members in contact with each other at their respective surfaces;

a metal member extending in an axial direction of the developer carrying member and that receives heat conducted from the developer stored in the developer storing case, wherein the metal member is provided at a position facing a portion in which the developer carrying member and the developer supplying member are in contact with each other; and a heat releasing device disposed in contact with the metal member and that releases the heat conducted from the metal member, the heat releasing device provided on at least one outer side of the developer storing case in the axial direction of the developer carrying member.

18. An image forming apparatus, comprising:

an image carrying member that carries a latent image on a surface of the image carrying member; and a development device disposed along the surface of the image carrying member, the development device including a developer storing case storing a developer;

at least one developer roller;

a metal member extending in an axial direction of at least one developer roller and that receives heat conducted from the developer stored in the developer storing case; and a heat releasing device disposed in contact with the metal member and that releases the heat conducted from the metal member, the heat releasing device provided on at least one outer side of the developer storing case in the axial direction of at least one developer roller, wherein the heat releasing device is integrated with the metal member to form a single unit.

* * * * *